United States Patent [19]

Haas et al.

[11] Patent Number: 4,633,823

[45] Date of Patent: Jan. 6, 1987

[54] AIR-COOLED INTERNAL COMBUSTION ENGINE HAVING COOLING RIBS AND COOLING AIR DEFLECTORS

[75] Inventors: Werner Haas; Dieter Hilker, both of Cologne, Fed. Rep. of Germany; Slezak, Pavel J., Pierrefonds, Canada

[73] Assignee: KHD Canada, Inc., Quebec, Canada

[21] Appl. No.: 710,172

[22] Filed: Mar. 11, 1985

[30] Foreign Application Priority Data

Mar. 9, 1984 [DE] Fed. Rep. of Germany ..... 3408624

[51] Int. Cl.[4] ..... F01P 1/02

[52] U.S. Cl. ..... 123/41.61; 123/41.69

[58] Field of Search ..... 123/41.69, 41.71, 41.5 E, 123/41.6, 41.61, 41.62

[56] References Cited

U.S. PATENT DOCUMENTS

| | | | |
|---|---|---|---|
| 1,398,849 | 11/1921 | Feddon et al. | 123/41.69 |
| 4,047,508 | 9/1977 | Schramm | 123/41.69 |
| 4,216,746 | 8/1980 | Freyn | 123/41.7 |
| 4,515,111 | 5/1985 | Vosmeyer et al. | 123/41.69 |

FOREIGN PATENT DOCUMENTS 1300344 7/1969 Fed. Rep. of Germany ... 123/41.69

*Primary Examiner*—William A. Cuchlinski, Jr.

*Attorney, Agent, or Firm*—Watson, Cole, Grindle & Watson

[57] ABSTRACT

An air-cooled, reciprocating piston, internal combustion engine has at least two adjacent cylinder barrels with a plurality of cooling ribs lying substantially perpendicular to the longitudinal axes of the barrels on at least part of the periphery thereof. The intake ports of the cylinder heads are located on the cooling air inlet side while the exhaust ports are located on the cooling air outlet side, and an air deflection cover overlies the cylinder barrels on the cooling air outlet side. The cylinder barrels are provided on the cooling air outlet side with cooling ribs lying substantially parallel to the longitudinal axes of the cylinder barrels. The air deflecting cover is of a configuration such that at least some of the cooling air flowing, in the area adjoining the crankcase, around and between adjacent cylinder barrels, is deflected toward these parallel lying ribs, so that essentially the total flow of cooling air supplied may be used to cool the hottest area of a cylinder barrels.

13 Claims, 4 Drawing Figures

AIR-COOLED INTERNAL COMBUSTION ENGINE HAVING COOLING RIBS AND COOLING AIR DEFLECTORS

BACKGROUND OF THE INVENTION

This invention relates to an air-cooled, reciprocating piston, internal combustion engine having at least two adjacent cylinder barrels on the crankcase thereof, and a plurality of cooling ribs lying substantially perpendicular to the longitudinal axes of the cylinder barrels on at least part of the periphery thereof. Cylinder heads on the cylinder barrels have inlet ports located on a cooling air inlet side thereof and exhaust ports on a cooling air outlet side thereof, and an air deflecting cover is mounted on the cylinder barrels at the cooling air outlet side thereof.

An air-cooled reciprocating piston internal combustion engine of the aforedescribed type is disclosed in a publication entitled "Luftgekuhlte Fahrzeugmotoren" by J. Mackerele, Frank'sche Verlagsbuchhandlung, Stuttgart, 1964, pages 171 to 173, describing a T 924 diesel made by Tatra-Werke CSSR. Such an engine has the entire periphery and length of the cylinder barrels provided with cooling ribs lying perpendicular to the longitudinal axes of the cylinder barrels, and being swept uniformly with cooling air from the inlet side thereof. The cooling air flowing laterally around and between adjacent cylinder barrels is passed, on the cooling air outlet side, by cooling air deflectors to a rear cooling rib area of the cylinder barrels on the outlet side.

Due to the position of the engine exhaust ports on the cooling air outlet side of this known arrangement, the rear areas of the cylinder barrels, on the cooling air outlet side, especially the cylinder barrel sections near the cylinder heads, are subjected to the highest thermal stresses. However, for the known reciprocating piston internal combustion engines, only the cooling air which has already been used for cooling the lateral peripheral areas, especially those near the cylinder heads of the cylinder barrels, and which have already therefore been heated, can be directed to such areas. Because of possible overheating, such a reciprocating piston internal combustion engine has only a limited output. In addition, and even if the power output is limited, since the flow of cooling air supplied must be adapted to the cooling air needed for cylinder barrel areas subjected to the highest thermal stress, excessive cooling cannot be avoided, under certain load conditions, at the front of the cylinder barrels at the air inlet side. This, in turn, gives rise to incomplete combustion and increased emission of pollutants.

SUMMARY OF THE INVENTION

It is therefore an object of the present invention to provide an air-cooled, reciprocating piston, internal combustion engine of the aforementioned type, in a manner to improve upon the cooling of the cylinder barrels, at the lowest possible production cost, so as to increase the output of the engine.

To achieve this objective, the air-cooled, multi-cylinder, reciprocating piston internal combustion engine according to the invention is provided, on the cylinder barrels at the cooling air inlet side, with cooling ribs lying substantially parallel to the longitudinal axes of the cylinder barrels, the air deflecting cover overlying such cooling ribs so that at least some of the cooling air which flows laterally around and between the adjacent cylinder barrels is capable of being deflected toward such cooling ribs. A large part of the flow of cooling air fed to the internal combustion engine may thus be used to cool the rear parts of the cylinder barrels which are subjected to high thermal stress and also to the parts of the cylinder barrels adjoining the cylinder heads which are subjected to the highest thermal stress, such flow of cooling air being directed, by means of such parallel lying ribs, toward the cylinder heads, i.e. toward the hottest parts thereof. This use of the total cooling air supplied, which is greatly improved as compared with known reciprocating piston internal combustion engines, the substantially increased cooling of the hot areas of the cylinder barrels, and the availability of using the cylinder barrel cooling air also for cooling the cylinder heads, provides the bases for increased power output from the internal combustion engine. The air deflecting means may be in the form of a cover made of sheet material, preferably of one piece and covering a row of cylinders laterally and on the air outlet side. Such an arrangement of the cooling ribs according to the invention involves no increase in production costs of the cylinder barrels and, as will be seen, offers the possibility of far more efficient and inexpensive production.

Other objects, advantages and novel features of the invention will become more apparent from the following detailed description of the invention when taken in conjunction with the accompanying drawings.

DETAILED DESCRIPTION OF THE INVENTION

Figures 1, 1A:
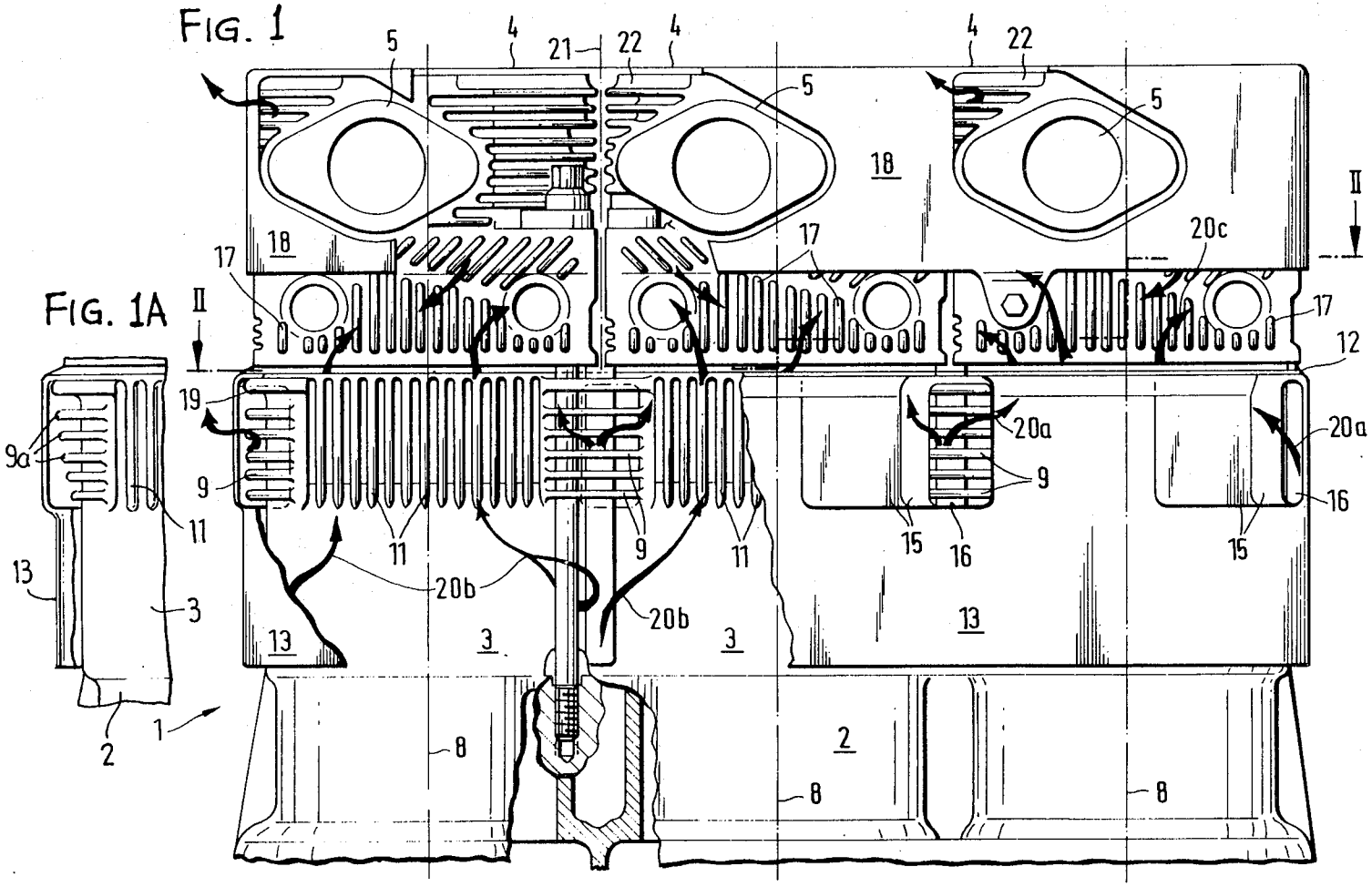
FIG. 1 is an elevational view, partly in section and partly broken away, from the cooling air outlet side, of a row of cylinders of the internal combustion engine according to the invention.
FIG. 1A is a view similar to FIG. 1 showing, in part, another variant of the invention.
Figure 2:
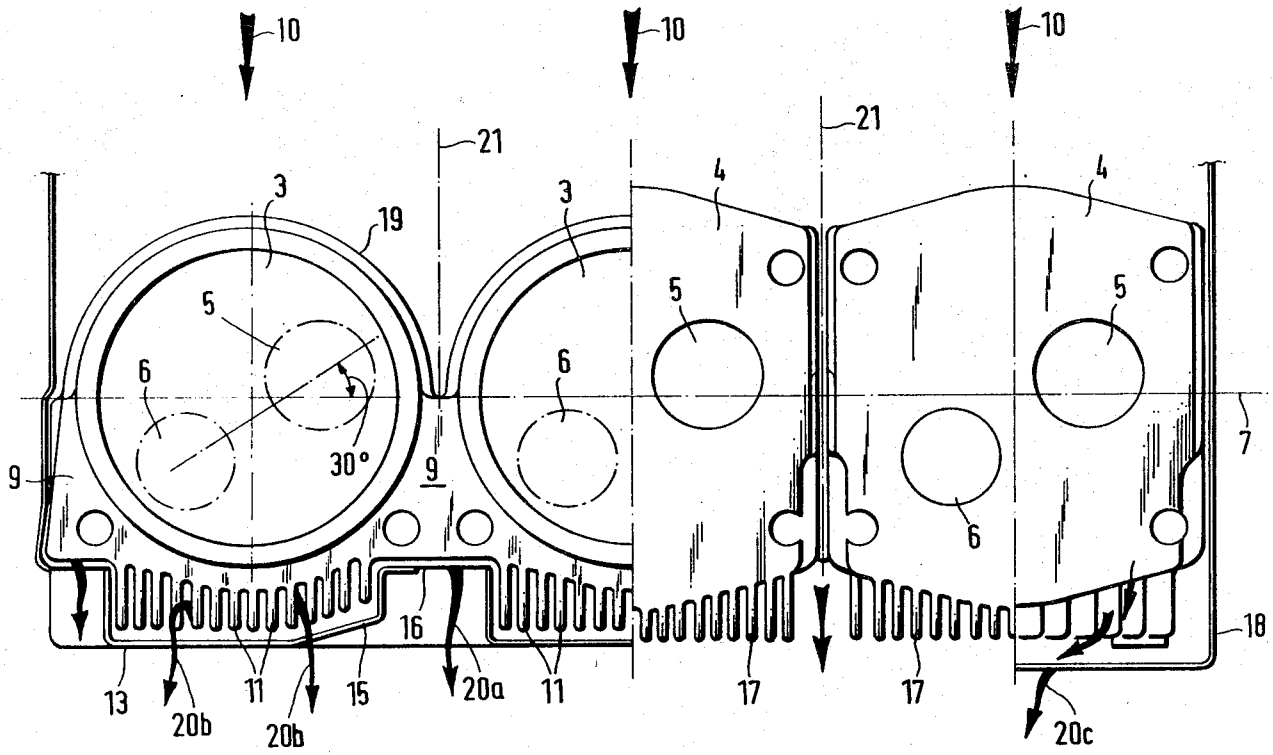
FIG. 2 is a view taken substantially along the line II—II of FIG. 1.

Referring now to the drawings, wherein like reference characters refer to like and corresponding parts throughout the several views, an air-cooled, reciprocating piston, internal combustion engine, generally designated 1, has a crankcase 2, a plurality of adjacent cylinder barrels 3, and separate cylinder heads 4. The cylinder barrels are integral with the crankcase and, as shown in FIGS. 1 and 2, cylinder head exhaust ports 5 are arranged on cooling air outlet side shown by arrows 10. Intake port 6, not shown in detail, is located on the cooling air inlet side, shown by arrows 20, where it opens out. The valves operating in ports 5 and 6, not shown in detail, are arranged such that planes passing through the valve stems thereof lie at an acute angle (about 30°) to a common transverse axis 7 of the row of cylinders.

A plurality of cooling ribs 9, lying perpendicular to the longitudinal axes 8 of the cylinder barrels, are provided on sections of the cylinder barrels adjoining the cylinder heads. These cooling ribs, as seen in the drawings, are located exclusively at a rear (outlet side) lateral peripheral area of each cylinder barrel section adjoining the cylinder head. Thus, on the cooling air inlet side, indicated in FIGS. 2 and 3 by arrows 10, the cylinder barrels may be provided without cooling ribs 9.

A plurality of further cooling ribs 11 according to the invention are provided on cylinder barrels 3 at the cooling air outlet side (depicted by arrows 20*a*, 20*b*), these ribs lying substantially parallel to longitudinal axes 8 of the cylinder barrels. These ribs extend substantially to upper end surfaces 12 of the cylinder barrels which adjoin the cylinder heads, and ribs 11 terminate at a predetermined axial distance from crankcase 2. Both sets of cooling ribs 11 and 9 are integrally formed with cylinder barrels 3.

An air deflecting means 13 overlies cooling ribs 9 and 11 of the cylinder barrels at the cooling air outlet side thereof, such means being in the form of a cover bent around the ends of the row of cylinders (FIG. 2) so that the row of cylinders is completely enclosed by such air deflecting means both laterally and on the outlet side, with adequate spacing 14 (FIG. 3) to permit the flow of air. At the opposing ends of each cylinder barrel at which cooling ribs 9 are located, the air deflecting means 13 has indentations 15 extending downwardly from end surfaces 12 and on the outlet side of the cooling ribs. These indentations contain air outlet openings 16 so that the cooling air (arrows 20*a*), flowing in these upper hot cylinder barrel sections can escape directly to the outside environment. These air outlet openings 16, for the cooling air flowing between the cylinder barrels, are offset relative to central planes 21 on opposite sides of which the cylinder barrels are defined, in a direction toward a respective exhaust port 5. In such a manner, the peripheral areas, in the vicinity of the exhaust ports of the cylinder barrels, and cooling ribs 9 thereof are cooled more intensively than the opposing peripheral areas of the cooling ribs (intake port areas) of the adjacent cylinder barrel.

Otherwise, after flowing through the unribbed front and side areas of cylinder barrels 3, the cooling air supplied is deflected (arrows 20*b*) by air deflecting means 13, on the cooling air outlet side, toward cooling ribs 11. Thus this total flow of cooling air which is at a relatively low temperature, may be used to cool the rear hot cylinder barrel area and is passed, via cooling ribs 11, to the hottest area of the cylinder barrels adjoining the cylinder heads. Since cooling ribs 11 are located at a distance from crankcase 2, this substantially ensures that accumulations of air, backflows, vortices, etc., are avoided at the outlet side flow passage 14 of air deflecting means 13.

This arrangement of cooling air guidance, together with the arrangement and configuration of cooling ribs 9 and 11, provides for optimum utilization of the total cooling air supplied and substantial uniformity of overall cylinder barrel temperatures. This, therefore, is an optimal way of establishing conditions for increasing the output from the internal combustion engine and reducing heat stress. And, between adjacent cylinder barrels, cooling ribs 9 are in heat conducting engagement so as to ensure a constant flow of heat from the hot peripheral area of a cylinder barrel (exhaust port 5) to the colder peripheral area (inlet port 6) of the adjacent cylinder barrel.

Figure 3:
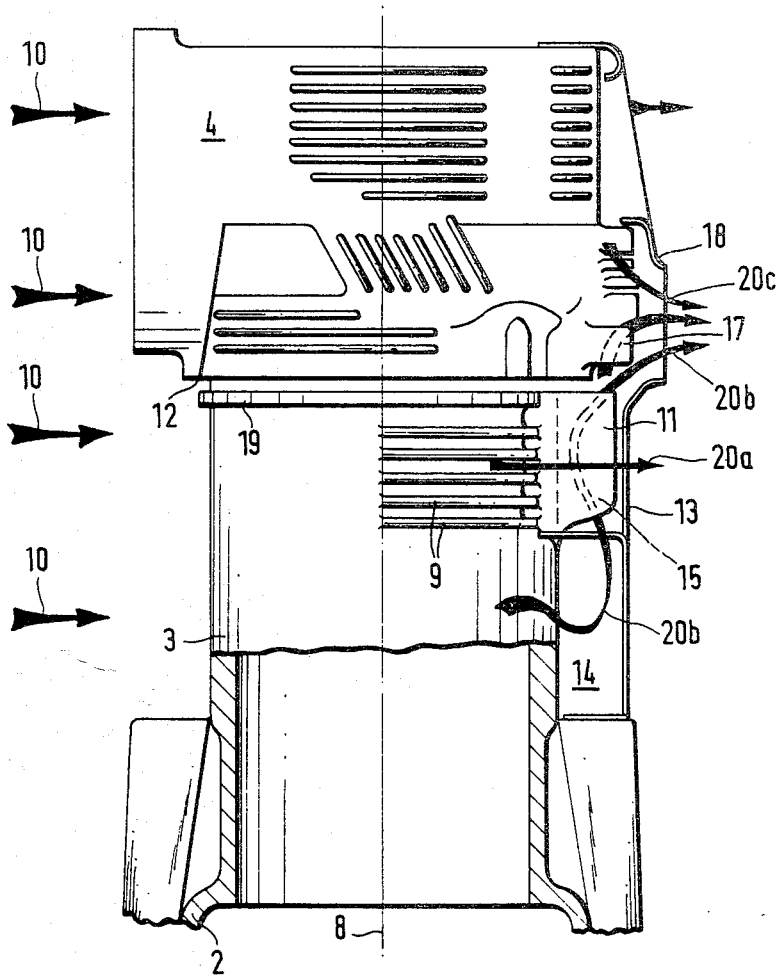
FIG. 3 is an end elevational view of a cylinder barrel with a cylinder head thereon, and showing the air deflectors of FIG. 1 in more detail.

Cylinder heads 4 also have, at their end areas adjoining the cylinder barrels, cooling ribs 17 lying substantially parallel to longitudinal axes 8 of the cylinder barrels, and are provided, on the cooling air outlet side, with air deflecting plates 18. Air deflecting means 13, and air deflecting plates 18, also extending over cylinder heads 4 of the entire row of cylinders, are spaced from each other at the outlet side and are outwardly bent about 90° at their edges. Thus, the cylinder barrel cooling air, after flowing through cooling ribs 11, is deflected toward cooling ribs 17 and can thus escape to the environment together with the cooling air (arrows 20*c*) for the cylinder heads in this area (FIG. 3). The cylinder barrel cooling air thus also contributes to the cooling of the hot end areas, adjoining the cylinder barrels, of the cylinder heads. Air deflecting plates 18 for the cylinder heads also include air outlet openings 22 so that, in the vicinity of exhaust ports 5, the cooling air can escape directly to the environment.

The integral assembly of cylinder barrels 3, crankcase 2 and cooling ribs 9 and 11 provide a reciprocating piston internal combustion engine as a unit employing a simple production technology, permitting favorable production costs and having outstanding stability. In area 12, adjoining the ends of the cylinder heads, the stable structure of the cylinder barrels may be improved by a provision of a reinforcing rib 19 extending around the entire periphery of the cylinder barrels and lying substantially perpendicular to axes 8.

Thus, as can be seen from the foregoing description, in order to be able to use, in particular, the relatively cold flow of cooling air from the lower parts of the cylinder barrels adjoining the crankcase for cooling the rear areas of such barrels, cooling ribs 11 extend substantially to end surfaces 12 of the cylinder barrels which adjoin the cylinder heads, and cooling ribs 11 terminate at a predetermined axial distance from the crankcase.

Cooling ribs 9 may be provided only on sections of the cylinder barrels adjoining the crankcase. As shown in FIG. 1A, such ribs 9*a* may have an outward extent which decreases substantially continuously from a maximum extent adjacent the cylinder heads to a minimum extent for the ribs lying closest to the crankcase. Otherwise, the remaining sections of the cylinder barrels have no ribs 9 or 9*a* thereon, as shown. With such an arrangement, it is possible for the mass flow of cooling air, to be fed to ribs 11, to be increased still further because of reduced flow resistances. In order to adapt to the thermal stress of the cylinder barrels, which declines in sections approaching the crankcase, cooling ribs 9 may decrease continuously in outward extent, or one or more sections of the cylinder barrels adjoining the crankcase may have cooling ribs 9*b* of constantly reduced outward extent. Another significant advantage of this arrangement according to the invention is that it takes into account, in an ideal manner, the different cooling needs of individual cylinder barrel sections, thus ensuring uniformity of cylinder barrel temperatures.

Cooling ribs 9 may be located only on sections of the cylinder barrels adjoining the cylinder heads so as to effect a desired optimized cooling of the hottest areas of the cylinder barrels and uniformity of cylinder barrel temperatures. In such an arrangement, shown in FIG. 1, the distance between the uppermost and lowermost ribs 9 substantially equals the axial extent of ribs 11. Thus, cylinder barrels with unribbed sections and sections ribbed according to the invention are employed to advantage from a production standpoint. Testing has shown that the cylinder barrels so devised make it possible, with the same output from the cooling blower, to achieve an almost 50% increase in the mass flow of cooling air supplied, as compared with existing cylinder barrel designs for reciprocating piston internal combustion engines. And, since the intake ports are located on the cooling air inlet side, the cylinder barrels are either provided without cooling ribs in the peripheral area on the cooling air inlet side, as shown in solid outline in FIG. 3, or are provided with cooling ribs 9 of reduced outward extent in the peripheral area on the cooling air inlet side, as shown in phantom outline in FIG. 3. This results in a further contribution to the uniformity of cylinder barrel temperatures and to the reduction of flow resistances. And, such an arrangement effectively reduces the danger of excessive cooling of individual cylinder barrel areas and sections, and thus the danger of an unduly high emission of pollutants.

If the stems of the intake and exhaust valves are arranged on the cooling air inlet side and the cooling air outlet side in such a manner that the planes passing through pairs of such intake and exhaust valve stems lie at acute angles to the common transverse axis 7 extending through the row of cylinder barrels, the peripheral area of the cylinder barrels, on the cooling air inlet side, is preferably designed without cooling ribs. Furthermore, cooling ribs 9 located between adjacent cylinder barrels are in heat conducting connection so that a constant flow of heat from the cooling ribs in the vicinity of an exhaust valve of the cylinder to the cooling ribs in the vicinity of the intake valve of an adjacent cylinder also contributes, in an advantageous manner, to the uniformity of temperatures of adjacent cylinders in a row. The present arrangement of the cooling ribs according to the invention also greatly reduces the cost of reduction, such as casting molds, mechanical machining, cores, etc. Furthermore, maintenance costs are also considerably reduced, for example as a result of simplified cleaning of substantially fewer cooling rib surfaces. Moreover, the cooling ribs are also arranged in areas in which, even for V-shaped engines, are easily accessible for cleaning.

And, the air deflecting means comprise components which are easy to produce, the configuration thereof being such that the cooling air, which has already been heated in the peripheral areas adjoining the cylinder heads, because of higher temperatures existing there, can be carried away to the environment through openings provided in such air deflecting means, so that only the relatively cold air flowing from the cylinder barrel sections adjoining the crankcase is used to cool the hot rear areas of the cylinder barrels. This permits higher cooling air velocities and thus higher cooling air mass flows in the peripheral areas of the cylinder barrels adjoining the cylinder heads. Moreover, in order to substantially eliminate vortices in the cooling air removed through such outlet openings, the air deflecting means has indentations in the vicinity of the air outlet openings adjacent end surfaces 12 adjoining the cylinder heads, on the cooling air outlet side. And, each outlet opening 16 is offset from central plane 21 in a direction toward an adjacent exhaust port 5, as shown in FIG. 2. Such an arrangement promotes uniformity of cylinder barrel temperatures, in that the air velocities obtained are higher in the vicinity of the exhaust ports than in the vicinity of the intake ports.

Moreover, cylinder heads 4 on the outlet side are provided with cooling ribs 17 on sections thereof which adjoin the cylinder barrels and lie substantially parallel to longitudinal axes 8 of the cylinders. Air deflecting plates 18 are mounted on the cylinder heads, and air deflecting means 13 adjacent the cylinder heads have an edge thereof outwardly bent about 90° (FIG. 3). Moreover, edges of plates 18 are outwardly bent about 90° adjacent the cylinder barrels. The edges of plates 18 and of means 13 are spaced apart at least in the area of cooling ribs 11 on the cylinder barrels, and means 13 extends almost to cooling ribs 17 on the cylinder heads. With such an arrangement, the flow of cooling air to the rear parts of the cylinder barrels, after leaving the cylinder barrel cooling ribs 11, may also be used to cool the rear cylinder head areas, i.e. substantially the vicinity of the exhaust port and exhaust valve. Likewise as provided for air deflecting means 13, air deflecting plates 18 may be provided with outlet openings 22 in the vicinity of exhaust ports 5, in order to provide more intensive cooling by increased mass flow of cooling air.

The advantages and effects of the invention (improved cooling, uniformity of cylinder barrel temperatures, reduced production costs, etc.) make it possible, in an ideal manner, to provide the cylinder barrels integral with the crankcase for the air-cooled internal combustion engine. The cooling ribs 9 of adjacent cylinder barrels may also be integral with the cylinder barrels, so that the crankcase and cylinder barrels are provided as a compact unit which is easy to produce.

As compared with known air-cooled internal combustion engines, in which separate cylinder barrels are normally secured to the crankcase with tie rods, the engine according to the invention permits substantial savings in major machining operations, so that in addition to functional advantages, the present engine provides considerably reduced production and assembly savings and thus considerable cost advantages. The integral design of the cylinder barrels and crankcase, with the adjacent cylinders being interconnected by cooling ribs 9, also increases the stability of the cylinder barrels and crankcase, so that the same can withstand higher torque stresses, for example. Moreover, as aforedescribed, this stability can be improved still further by the provision of a reinforcing rib such as 19 in the vicinity of end surfaces 12 of the cylinder barrels.

Obviously, many other modifications and variations of the present invention are made possible in the light of the above teachings. It is therefore to be understood that within the scope of the appended claims, the invention may be practiced otherwise than as specifically described.

What is claimed is:

1. An air-cooled, reciprocating piston, internal combustion engine having a crankcase and at least two adjacent cylinder barrels on said crankcase, comprising a plurality of cooling ribs lying substantially perpendicular to the longitudinal axes of said cylinder barrels on at least a part of the periphery thereof, cylinder heads on said cylinder barrels, said heads and said barrels having a cooling air inlet side and a cooling air outlet side, said heads each having an intake port at said inlet side thereof and each having an exhaust port at said outlet side thereof, at least one air deflecting means mounted on said outlet side of said cylinder barrels, and said cylinder barrels having cooling ribs on said outlet side thereof lying substantially parallel to said longitudinal axes, said air deflecting means overlying said parallel lying cooling ribs whereby at least some cooling air which flows laterally around and between said adjacent cylinder barrels is capable of being deflected toward said parallel lying cooling ribs.

2. The engine according to claim 1, wherein said parallel lying cooling ribs extend substantially to end surfaces of said cylinder barrels which adjoin said cylinder heads, and said parallel lying cooling ribs terminate at a predetermined axial distance from said crankcase.

3. The engine according to claim 1, wherein said perpendicular lying cooling ribs are located only on sections of said cylinder barrels adjoining said cylinder heads and together being spaced from said crankcase, one of said ribs on said sections adjacent said cylinder heads having a maximum outward extent and the remaining ribs on said section gradually decreasing in outward extent relative to said maximum extent.

4. The engine according to claim 1, wherein said parallel and said perpendicular lying cooling ribs are located only on said outlet side of said cylinder barrels.

5. The engine according to claim 1, wherein each of said cylinder barrels has an inlet and an exhaust port, inlet and exhaust valves respectively operating in said ports, planes passing through the valve stems of said valves of each of said cylinders lying at acute angles to a common transverse axis of said cylinder barrels.

6. The engine according to claim 1, wherein said perpendicular lying cooling ribs are in heat conducting connection between said adjacent cylinder barrels.

7. The engine according to claim 1, wherein said perpendicular lying cooling ribs are integral with said cyliner barrels.

8. The engine according to claim 1, wherein said cooling ribs in heat conducting connection are located on sections of said cylinder barrels adjoining said cylinder heads, and said perpendicular lying cooling ribs are located on outer end sections of said cylinder barrels adjoining said cylinder heads, said air deflecting means comprising a cover having air outlet opening located at said perpendicular lying cooling ribs to facilitate the flow of the cooling air laterally around and between said cylinder barrels at said sections adjoining said cylinder heads.

9. The engine according to claim 8, wherein said cover has indentations in the vicinity of said air outlet openings and at ends of said cylinder barrels adjacent said cylinder heads, whereby any vortices in the cooling air through said air outlet opening are substantially avoided.

10. The engine according to claim 1, wherein said cylinder heads have on the outlet side thereof cooling ribs on sections thereof which adjoin said cylinder barrels and lie parallel to said longitudinal axis thereof, air deflecting plates mounted on said cylinder heads, and said air deflecting means adjacent said cylinder heads having an edge thereof outwardly bent about 90°, and edges of said plates being outwardly bent about 90° adjacent said cylinder barrels, said edges of said plates and of said air deflecting means being spaced apart at least in the area of said parallel lying cooling ribs on said cylinder barrels, and said edge of said cover extending toward said parallel lying cooling ribs on said cylinder heads.

11. The engine according to claim 10 wherein said air deflecting plates have cooling air outlet openings in the vicinity of said outlet ducts.

12. The engine according to claim 1, wherein said cylinder barrels are integral with said crankcase.

13. The engine according to claim 1, wherein reinforcing ribs lying perpendicular to said longitudinal axes are located on said cylinder barrels adjacent end surfaces thereof which adjoin said cylinder heads.

* * * * *